United States Patent [19]

Lewis

[11] 4,037,551

[45] July 26, 1977

[54] TEAR-OFF CLOSURE AND METHOD OF FORMING THE SAME

[75] Inventor: Paul R. Lewis, Richmond, Ind.

[73] Assignee: Aluminum Company of America, Pittsburgh, Pa.

[21] Appl. No.: 661,255

[22] Filed: Feb. 25, 1976

[51] Int. Cl.[2] ..... B21D 51/44

[52] U.S. Cl. ..... 113/121 C; 113/15 A

[58] Field of Search ..... 113/121 A, 121 C, 15 R, 113/15 A; 215/254, 256, 304, 305

[56] References Cited

U.S. PATENT DOCUMENTS

| | | | |
|---|---|---|---|
| 2,119,662 | 6/1938 | Williams | 113/121 A |
| 3,865,268 | 2/1975 | Coop | 215/256 |
| 3,931,904 | 1/1976 | Coop | 215/254 |
| 3,976,215 | 8/1976 | Smalley | 215/305 |

*Primary Examiner*—Michael J. Keenan

*Attorney, Agent, or Firm*—David W. Brownlee; William J. O'Rourke, Jr.

[57] ABSTRACT

An improved tear-off closure for a container is disclosed having a circular top end wall, a closure skirt depending from the top end wall, an annular rim projecting radially outwardly from the bottom of the closure skirt and an integral concentric pull ring around the annular rim. The pull ring comprises a curled bead having a radially inwardly open slot therein into which a terminal edge portion of the annular rim projects to secure the pull ring in a fixed position of the base of the closure skirt prior to sealing of the closure on a container. A method and tools for forming such a closure are also disclosed.

4 Claims, 17 Drawing Figures

TEAR-OFF CLOSURE AND METHOD OF FORMING THE SAME

BACKGROUND OF THE INVENTION

1. Field of Invention

The present invention relates to a container closure and more particularly to an improved tear-off closure and a method of forming such closure having an integral, concentric pull ring for manually removing the closure from a container on which it is sealed. The pull ring on the closure of the present invention is formed such that the ring is held in a fixed position at the bottom of the closure prior to sealing of the closure on a container.

2. Description of the Prior Art

A tear-off closure having an integral concentric pull ring for removing the closure from a container is described in U.S. Coop Pat. No. 3,865,268. The closure disclosed in that patent has an integral skirted cap wall depending from the periphery of a cap top and a curled beam which forms a pull ring around the closure skirt. The pull ring is connected to the closure skirt through a sever line provided by either a score line or slits and bridges adjacent the bead at the bottom of the cap wall. Such connection of the pull ring to the closure skirt secures the ring in position on the closure prior to sealing of the closure on a container at which time the sever line is broken or severed. The secured position of the pull ring on the closure prior to capping facilitates handling and hoppering of the closures as is necessary to bring them into position for capping a container.

Although a score line or slits and bridges in the sever line in the closure disclosed in U.S. Pat. No. 3,865,268 usually works well, such sever line is somtimes accidentally broken during forming of the closure. The score line or slits and bridges must usually be formed prior to forming of the curled bead and may be prematurely broken or severed during such curling. Additionally, upon capping of a container with a closure of U.S. Pat. No. 3,865,268, the ruptured edges of the score or bridges on the pull ring may sometimes project from the ring in such a way as to pose a risk of cutting the fingers of the consumer.

Accordingly, an improved tear-off closure, and method of forming the same, is desired which will assure that the pull ring remains peripherally attached around the base of the closure skirt prior to the capping operation and also assures safe removal of the closure from a container on which it is applied.

SUMMARY OF THE INVENTION

This invention may be summarized as providing an improved tear-off closure for a container comprising a circular top end wall, a closure skirt depending from the top end wall, an annular rim projecting radially outwardly from the bottom of the closure skirt and an integral concentric pull ring around the annular rim. In the broad aspects of this invention, the pull ring comprises a curled bead having a radially inwardly open slot therein into which a terminal edge portion of the annular rim projects to secure the pull ring in a fixed position at the base of the closure skirt prior to sealing of the closure on a container.

This invention may be further summarized as providing a method of forming a beaded pull ring secured in position at the bottom of a closure skirt by curling the bottom edge of a depending wall on the closure skirt inwardly under an outwardly projecting annular rim around the bottom of the closure skirt, and curling a top edge of the depending wall inwardly over the terminal edge of the annular rim, whereby the terminal edge of the annular rim is held within a slot in the beaded pull ring formed by such curling operation.

Among the advantages of the subject invention is the provision of a new and improved tear-off closure having an integral, concentric pull ring for removing the closure from the container, in which the pull ring remains peripherally attached at the base of the closure skirt prior to sealing of the closure on a container.

This invention also assures safe removal of the tear-off closure from the container on which it is applied by eliminating any edges of exposed metal on the inside surface of the pull ring which could irritate or lacerate the finger of a potential consumer.

It follows that an advantage of the subject invention is the provision of a method of forming a new and improved tear-off closure having an integral, concentric pull ring which maintains its peripheral attachment at the base of the closure skirt prior to sealing of the closure on a container.

The above and other objects and advantages of this invention will be more fully understood and appreciated with reference to the following description and the drawings appended hereto.

DESCRIPTION OF THE REFERRED EMBODIMENTS

Figure 1:
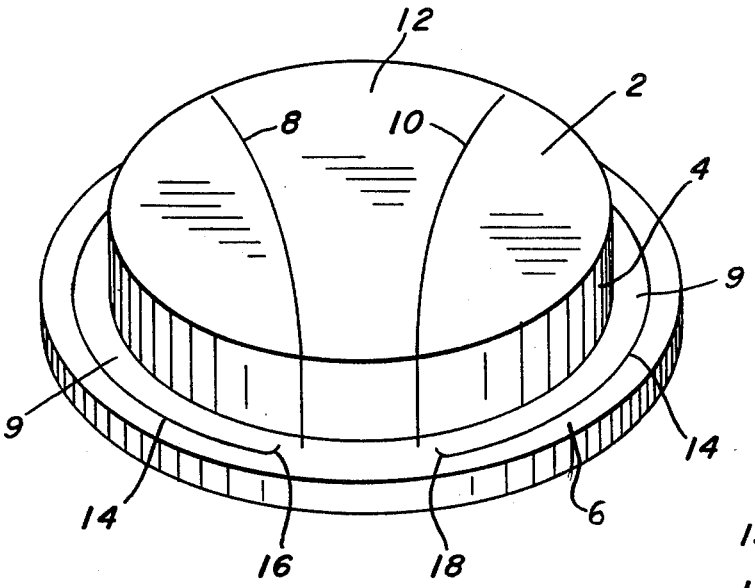
FIG. 1 is a perspective view of an improved tear-off closure of the present invention.

Referring particularly to the drawings, FIG. 1 illustrates an improved tear-off closure of this invention. The generally cup shaped closure includes a circular top end wall 2, a depending closure skirt 4 around the top end wall 2, an annular rim 9 projecting radially outwardly around the bottom of the closure skirt 4 and an integral pull ring 6 around the annular rim 9. A pair of score lines 8 and 10 extend from adjacent points on the depending skirt 4 at the pull ring 6 across the closure skirt 4 and the top end wall 2 to terminal ends at or near the junction of the top end wall 2 and the closure skirt 4. The score lines 8 and 10 define a tear strip 12 across the closure which is adapted to be severed to permit removal of the closure from a sealed container, as will be described.

The pull ring 6 comprises a curled bead around the closure skirt 4 integrally connected to the base of the tear strip 12 at the bottom portion of the closure skirt 4. A line of separation 14 extends from a location adjacent the score line 8 on one side of the tear strip 12 around the closure skirt 4 to a location adjacent the other score line 10 on the other side of the tear strip 12. This line of separation 14 is adapted to permit separation of the pull ring 6 from the closure skirt 4 during capping of a container. In a preferred embodiment of a tear-off closure of this invention, the line of separation 14 comprises a line along which the metal in the closure is cut through except for possibly a couple of narrow bridges 13 of metal which connect the pull ring 6 to the closure skirt 4. The bridges 13 are useful primarily during the forming operation as will be explained, but may also help in maintaining the pull ring 6 in proper position on the closure after the closure has been formed.

The terminal ends 16 and 18 of the line of separation 14, as seen in FIG. 1, are preferably spaced from the score lines 8 and 10 which define the tear strip 12. This leaves a bridge of unscored or unweakened metal between both ends of the line of separation 14 and the tear strip 12. The unweakened metal helps prevent accidental rupture of the score lines 8 and 10 as can otherwise occur either during sealing of the closure on a container or when the sealed container holds relatively high internal pressures as frequently occurs with bottles of beer and carbonated beverages. The terminal ends 16 and 18 of the line of separation 14 are also preferably curved inwardly and upwardly toward the score lines 8 and 10 to facilitate rupture of the score lines along the tear strip during removal of the closure from a sealed container, as will be explained.

Figure 9:
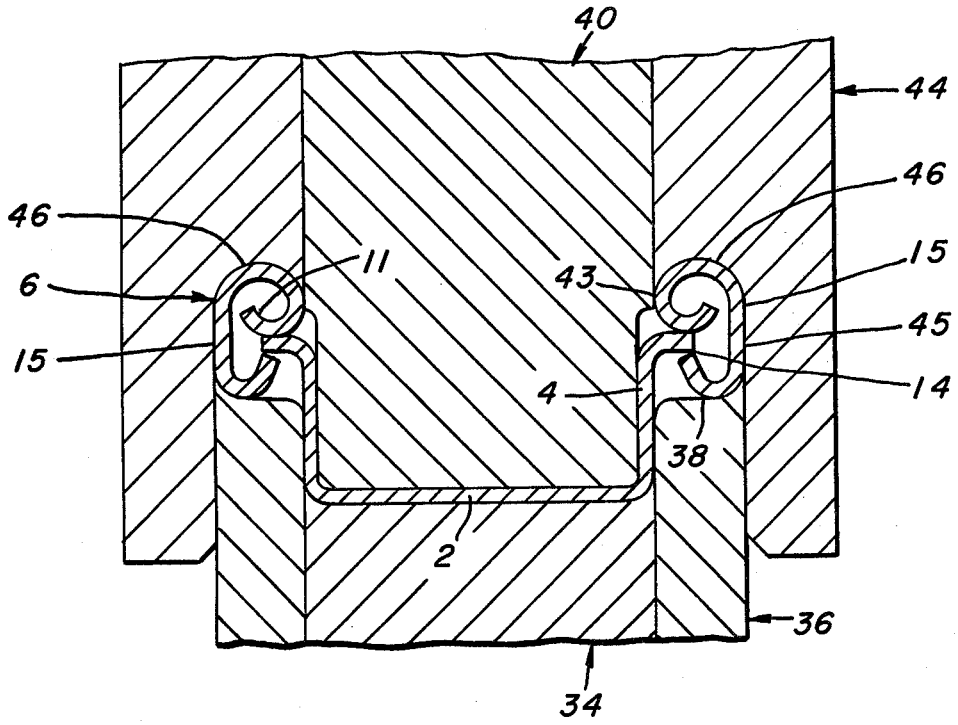
FIG. 9 is a cross-sectional view similar to FIGS. 7 and 8 showing completion of the pull ring.

It is a feature of this invention that the pull ring 6 is held in its proper position at the base of the closure skirt 4 by entrapment of a terminal edge portion 19 of the annular rim 9 in an inwardly open slot in the curled bead which forms the pull ring 6 as is shown in FIG. 9. Such entrapment of the terminal edge portion 19 to secure the pull ring 6 in position is a significant improvement over the score line or the slits and bridges which are relied on to secure the pull ring of U.S. Pat. No. 3,865,268 because entrapment is more reliable and eliminates any projecting edges on the pull ring which could cut the fingers of the consumer. In the closure of U.S. Pat. No. 3,865,268, the score line or bridges could sometimes be broken during curling of the bead, resulting in a pull ring which would not be held in position on the closure. Thus, the pull ring could interfere with handling and hoppering of such a closure in preparation for sealing it on a container. With this invention, the pull ring 6 is secured in position even if the bridges 13 are broken during the curling operation. The edges of the metal in the pull ring 6 are also turned generally into the curled bead and do not pose a risk to the consumer. Even the edges of any broken bridges 13 are turned generally into the bead so they also will not cut the fingers of a user.

Figure 2:
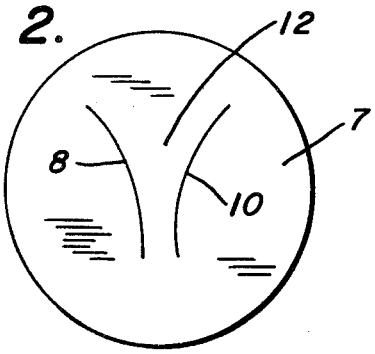
FIG. 2 is a plan view of a scored blank from which the closure of the present invention is formed.

A preferred method of forming the tear-off closure of this invention begins by cutting score lines 8 and 10 in light gauge sheet metal such as CH14 aluminum alloy in an extra hard temper (H19) at 0.0090 inch gauge, and then cutting or blanking a circular disc 7 from the sheet metal with the score lines 8 and 10 therein, as illustrated in FIG. 2. The score lines 8 and 10 define a tear strip 12 in the closure which will be formed from the disc 7. To facilitate severance of such tear strip 12 the score lines 8 and 10 are preferably formed so as to run substantially parallel with the grain of the metal disc 7. In a preferred embodiment, the score lines 8 and 10 each have an arc shape and diverge or draw apart from the ends thereof which will be adjacent the pull ring 6 in the formed closure to the other ends thereof which will be in the top end wall 2 of the formed closure as seen in FIG. 1. The narrowest width of the tear strip 12 defined by such score lines 8 and 10 is preferably adjacent the beaded pull ring 6.

Figure 4:
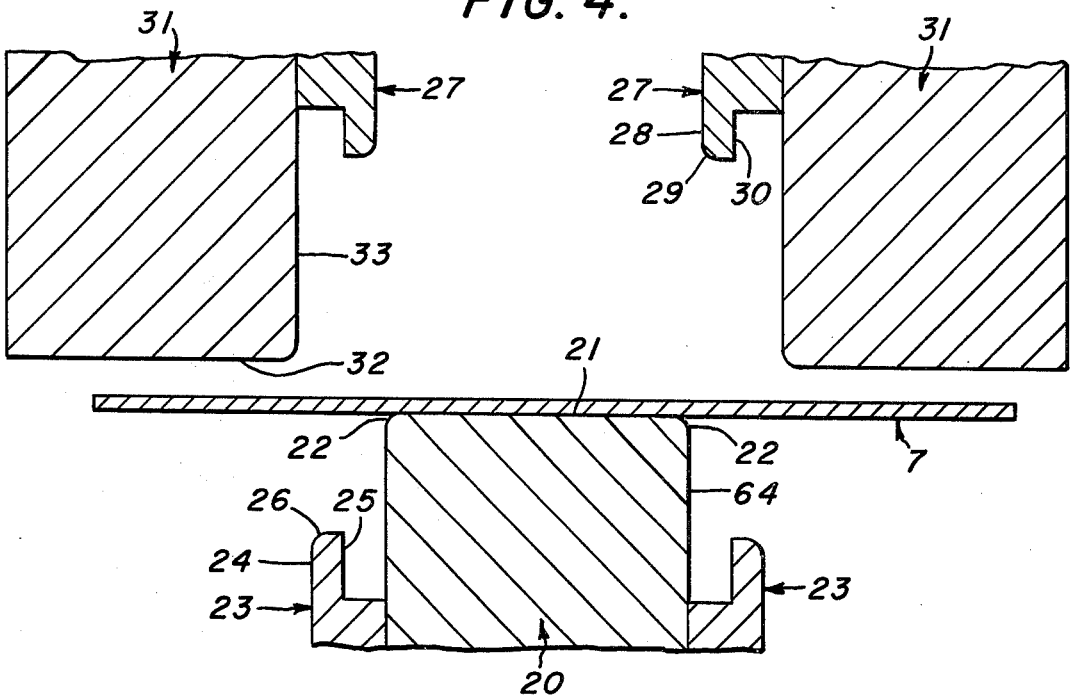
FIG. 4 is an enlarged cross-sectional view through dies for forming a cut blank into a generally cup shape.
Figure 5:
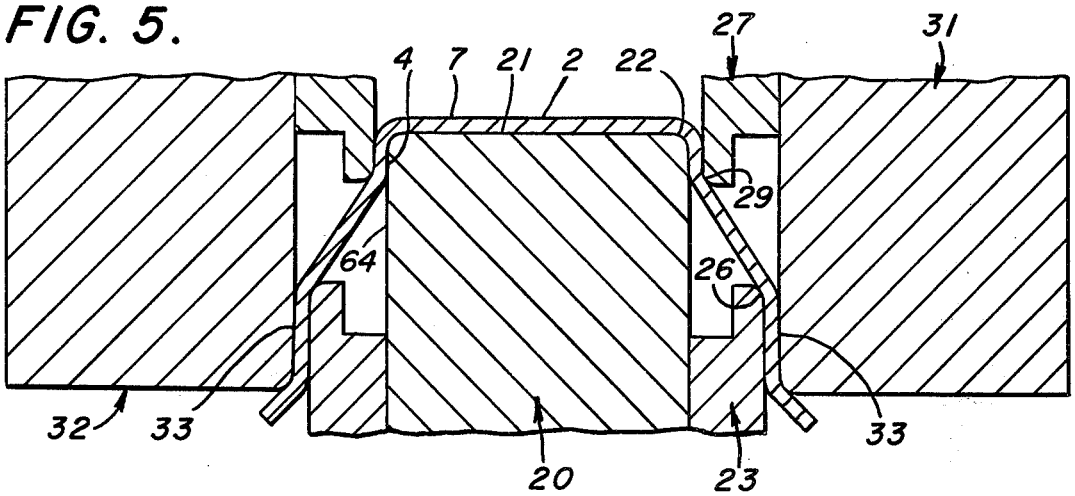
FIG. 5 is a cross-sectional view similar to FIG. 4 with the generally cup shape partially formed.
Figure 6:
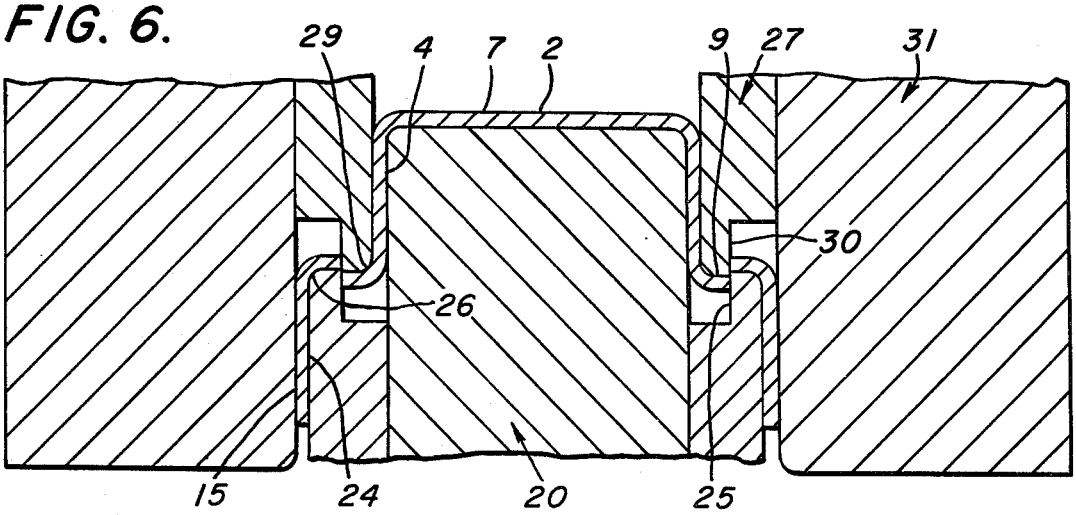
FIG. 6 is a cross-sectional view similar to FIGS. 4 and 5 showing completion of the generally cup shape.

The closure of this invention is preferably formed from the disc 7 in two steps. FIGS. 4, 5 and 6 illustrate exemplary opposing upper and lower dies which are employed in the first step of drawing and forming the circular metal blank 7 into a generally cup shape and cutting a line of separation 14 therein. The lower dies include a first circular die member 20 with a planar top surface 21, a rounded outer corner surface 22 and an outwardly facing surface 64. Around the circular die member 20 is a die ring 23 having an outwardly facing shaping surface 24 extending through a rounded corner 26 and terminating at an inwardly facing shearing surface 25. The bottom die member 20 and the die ring 23 are held in fixed position for forming the blank 7 against the upper punch members.

The upper dies include a shear ring 27 having an inwardly facing shaping surface 28 extending through a rounded corner 29 and terminating at an outwardly facing shearing surface 30. Around the shear ring 27 is a punch ring 31 having a generally planar downwardly facing base surface 32, and an inwardly facing wall surface 33. While it would be understood by those skilled in the art that either the shear ring 27 or the punch ring 31, or both, may be spring loaded, in the preferred embodiment, they are solidly held in the upper die and remain stationary with respect to each other throughout the forming operation.

The upper dies are adapted to be moved toward the lower dies with the outwardly facing surface 64 of the circular die member 20 mating with the inwardly facing shaping surface 28 of the shear ring 27, and the outwardly facing shearing surface 30 of the shear ring 27 mating with the inwardly facing shearing surface 25 of the die ring 23. Additionally, the outwardly facing shaping surface 24 of the die ring 23 is adapted to mate with the inwardly facing wall surface 33 of the punch ring 31.

FIG. 5 illustrates an intermediate position of the dies during forming of the circular metal blank 7 into a generally cup shape which is to be subsequently formed into a tear-off closure of this invention. During closing of the dies as by downward travel of the upper dies to the position illustrated in FIG. 5, the base surface 32 of the punch ring 31 engages the outer peripheral portion of the metal disc 7 and bends such outer portion over the rounded corner 22 and against the surface 64 of the circular die member 20. With further closing of the dies, the punch ring 31 bends or forms the peripheral edge of the metal disc 7 over the rounded corner 26 of the die ring 23, and the rounded corner 29 of the shear ring 27 engages the metal disc 7 to draw the metal tightly around the corner 22 on the bottom die member 20. This shapes the top end wall 2 of the closure to correspond with the planar top surface 21 of the die member 20 and begins to form the closure skirt 4. To permit such drawing, a clearance of slightly more than the thickness of the metal disc is provided between the inwardly facing shaping surface 28 and the outwardly facing surface 64 on the die member 20.

FIG. 6 illustrates completion of the first step in forming the blank 7 into a generally cup shape. As illustrated, the punch ring 31 has completed its downward travel and has formed the peripheral edge portion of the circular metal disc 7 over the rounded corner 26 and against the shaping surface 24 of the die ring 23 to form the depending wall 15 on the cup. Additionally, the downward travel of the shear ring 27 has drawn the metal from the disc between the surface 28 on the ring 27 and the surface 64 on the die 20 to form the closure skirt 4. A generally annular rim 9 has also been formed around the periphery of the enclosure between the corner 29 on the shear ring 27 and the corner 26 on the die ring 23.

Figure 3:
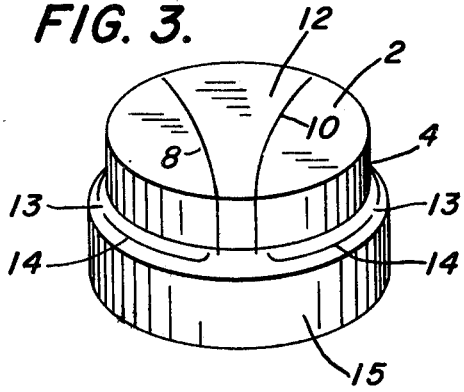
FIG. 3 is a perspective view of a closure of the present invention drawn into a general cup shape from a blank as shown in FIG. 2.

At the completion of the downward travel of the upper dies, the conjoint action of the shearing surface 30 of shear ring 27 and the shearing surface 25 of die ring 23 shears or cuts the metal in approximately the center of the annular rim 9 along the line of the shearing surfaces. This shear line around the periphery of the cup shape closure in the annular rim 9 defines the line of separation 14 in the closure. The line of separation 14 preferably does not extend completely around the annular rim 9. Rather, the line of separation 14 extends from a location adjacent the score line 8 on one side of the tear strip 12 around the annular rim 9 to a location adjacent the other score line 10 on the other side of the tear strip 12, as shown in FIG. 3. In a preferred embodiment the line of separation 14 is also interrupted by one or more narrow bridges of metal 13 as also shown in FIG. 3. To avoid shearing the metal in the tear strip and the bridges 13, the corresponding sharp edges of the shearing surfaces 25 and 30 are interrupted or machined off where the bridges 13 and the tear strip 12 are to be located such that shearing will not occur at such locations when the upper dies have completed their downward travel. The unscored metal in the bridges 13 in conjunction with the unscored metal in the tear strip 12 insures that the depending wall 15 is held in position on the annular rim 9 to facilitate efficient handling of the closures prior to curling the bead in the second formation step. In the absence of the bridges 13, the bottom portion of the closure would be loosely connected to the closure which would make it difficult to properly position the formed cup in the next set of dies.

To remove the formed cup from the dies, holes, not shown, may be provided through the circular die member 20, terminating at its top surface 21 for discharge of spurts of air therethrough to blow the closure out of the open dies. It should be understood by those skilled in the art that knockout dies may also be utilized to remove the closure.

Figure 7:
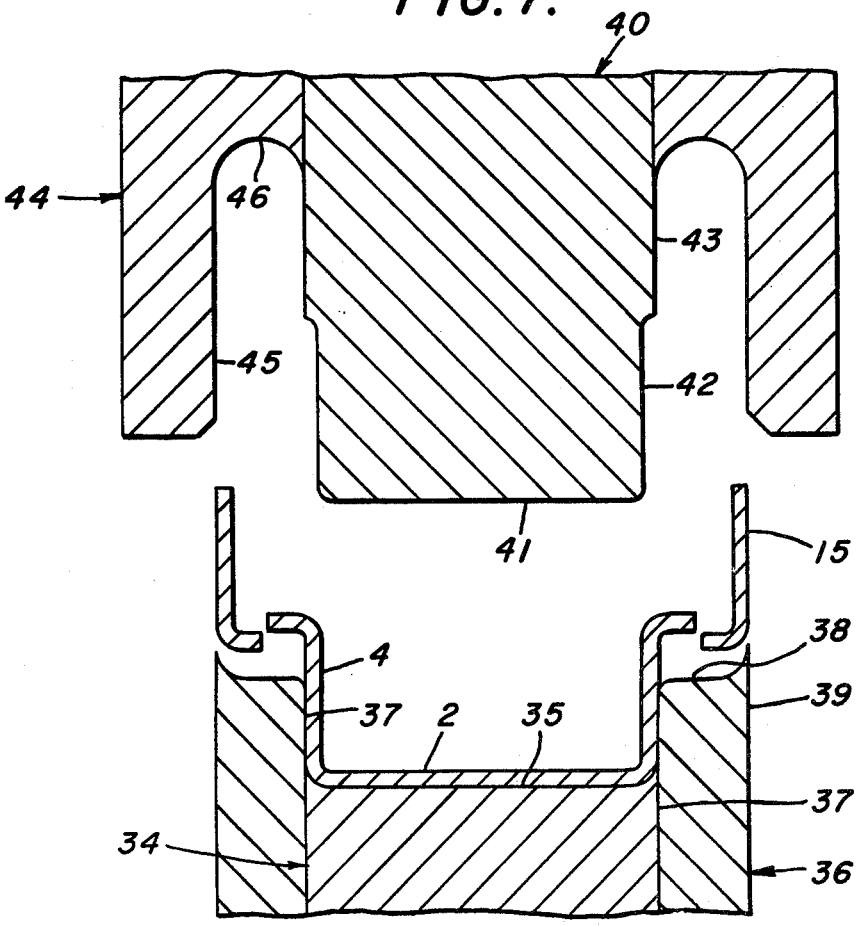
FIG. 7 is an enlarged cross-sectional view through dies for forming a pull ring on the generally cup shape closure shown in FIG. 6.
Figure 8:
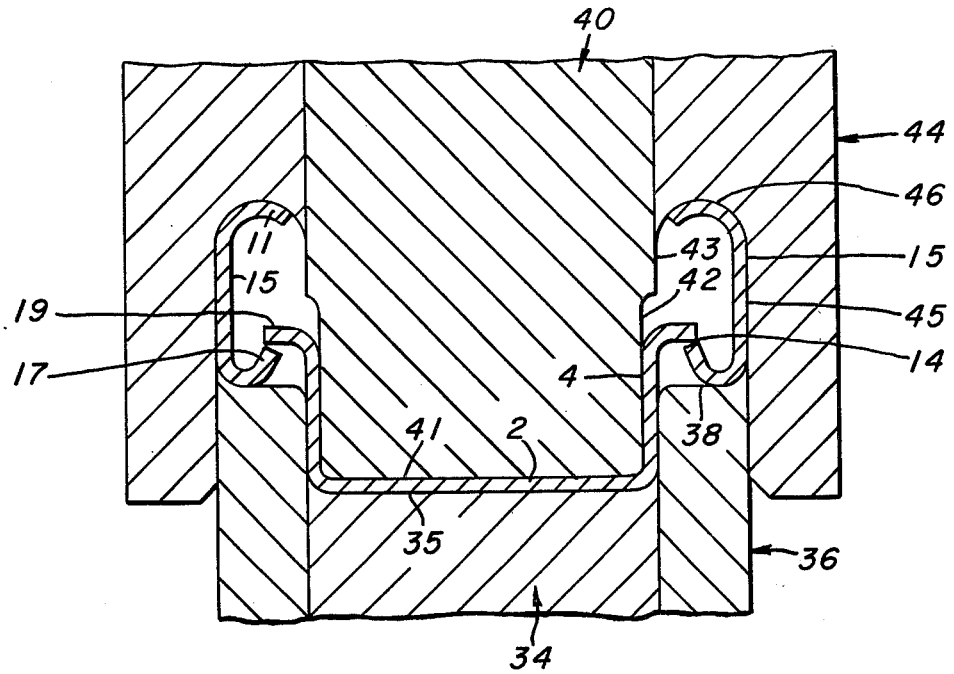
FIG. 8 is a cross-sectional view similar to FIG. 7 with the pull ring partially formed.

FIGS. 7, 8 and 9 illustrate exemplary opposing dies which are employed in forming a beaded pull ring 6 around the annular rim 9 at the base of the closure skirt 4. As shown in FIG. 7, the lower dies include a circular knockout tool 34 with an upwardly facing top surface 35 conforming with the outside surface of the top end wall 2 of the closure. Around the knockout tool 34 is a support ring 36 having a circular inside wall 37 with a diameter substantially corresponding to the outside diameter of the closure skirt 4. The support ring 36 further has a curling surface 38 and an outside wall 39. The support ring 36 is preferably stationary or fixed while the knockout tool 34 is supported by springs or the like, not shown, so it can move downwardly in response to an upper die member moved thereagainst, and also spring upwardly to eject the closure out from dies when they are opened after completion of the forming operation.

The upper dies include a circular punch insert 40 having a downwardly facing base surface 41 conforming with the inside surface of the top end wall 2 of the closure. The punch insert further has a first wall surface 42 having a diameter substantially corresponding to the inside diameter of the closure skirt 4 and a height preferably slightly greater than that of the closure skirt 4. The first wall surface 42 of the punch insert 40 preferably terminates at a second wall surface 43 having a diameter substantially corresponding to the outside diameter of the closure skirt 4. Around the punch insert 40 is a curling ring 44 having a generaly planar inside wall 45 which mates with the outside diameter of the depending wall 15 of the closure and the outside wall 39 of the support ring 36 when the upper dies are subsequently lowered. The inside wall 45 of the curling ring 44 terminates at a generally arc shaped curling surface 46.

As illustrated in FIG. 7, the closure has been inverted or turned upside down from its position in the first step of formation shown in FIGS. 4, 5 and 6 such that the top end wall 2 of the closure is downwardly facing and is seated on the knockout tool 34 with the closure skirt 4 seated within a portion of the inside wall 37 of the support ring 36 which projects above the top surface 35 of the knockout tool 34. The reason for inverting the closure in the dies of FIG. 7 is for ease in transporting and properly seating the cup shaped closure inside a mating recess defined by the lower dies.

FIG. 8 illustrates an intermediate step in forming the concentric pull ring 6 on the closure. During die travel to the position illustrated in FIG. 8, the base surface 41 of the punch insert 40 first engages the inside surface of the top end wall 2 of the closure. Further downward travel of the upper dies causes the spring loaded knockout tool 34 and likewise the closure to be driven downwardly with respect to the ring 36 until the inside shell of the closure defined by the top end wall 2 and the annular rim 9 engages the curling surface 38 of the stationary support ring 36. From that point to completion of the formation of the pull ring 6, only the curling ring 44 moves while the other dies remain relatively stationary. As the curling ring 44 proceeds in a downward direction, the inside surface 45 will define outermost diameter of the pull ring 6 to be formed. As the terminal edge 11 of the wall 15 of the closure is engaged by the curling surface 46 on the curling ring 44, such edge 11 is reformed or curled inwardly with respect to the closure skirt 4 to conform with the configuration of the curling surface 46.

Substantially simultaneously with the initial curling of the peripheral edge 11 of the depending wall 15 the opposite end 17 of the wall 15 immediately adjacent the line of separation 14 in the closure is forced downwardly into and reformed by the curling surface 38 of the support ring 36. Continued downward travel of the curling ring 44 drives the edge 17 of the wall 15 defining the line of separation 14 inwardly into engagement with a corresponding terminal edge portion 19 of the annular rim 9 also defining the line of separation 14 to effectively prevent further curling of the end of the wall 15 adjacent the line of separation 14.

It should be understood that any bridges 13 of metal or interruptions provided in the line of separation 14 may be severed during the curling of the depending wall 15. However, as is explained below, the curling will result in entrapment of the terminal edge portion 19 of the outwardly facing annular rim 9 inside an inwardly facing slot in the concentric pull ring 6.

FIG. 9 illustrates the completion of forming an integral concentric pull ring 6 at the base of the closure skirt 4. As the curling ring 44 proceeds downwardly to the position shown in FIG. 9, the outer peripheral edge 11 of the wall 15 continues to follow the contour of the curling surface 46 until it engages the second wall surface 43 of the punch insert 40. Further downward travel of the curling ring 44 curls the peripheral edge 11 of the wall 15 inwardly upon and along the terminal edge portion 19 of the annular rim 9 at the base of the closure skirt 4. The conjoint compression of both ends 11 and 17 of the curled depending wall 15 against the terminal edge portion 19 of the annular rim 9 at the base of the closure skirt 4 thereby entraps the edge 19 of the rim 9 within the formed pull ring 6. Also, the curling of the edges 15 and 17 has another important function of not cutting the fingers of the consumer during opening of the closure.

As shown in FIG. 9, the edge 17 of the depending wall 15 has been turned into an inwardly curled bead underlying the outwardly projecting annular rim 9. Also, the other edge 11 of the depending wall 15 has been turned radially inwardly over the terminal edge 19 of the annular rim 9. Between the inwardly curled edges 11 and 17 is formed an inwardly facing slot extending around the periphery of the formed pull ring 6. The terminal edge 19 of annular rim 9 at the base of the closure skirt 4 projects into and will perferably remain entrapped in this slot until the closure is applied onto a container, as will be explained below.

Figure 16:
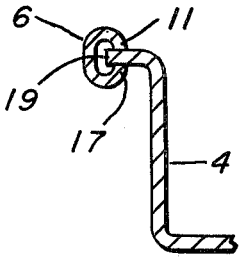
FIG. 16 is a partial cross-sectional view showing an alternative embodiment of the pull ring.
Figure 17:
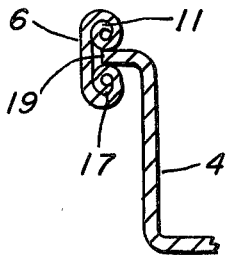
FIG. 17 is a partial cross-sectional view showing an alternative embodiment of the pull ring.

The preferred embodiment illustrates a pull ring 6 having edge 17 curled inwardly against the edge 19 of the annular rim 9 and edge 11 curled inwardly beyond the annular rim 9. It should also be understood by those skilled in the art that edges 11 and 17 could be curled such that both are driven into engagement with the top and bottom of the annular rim 9, or that edges 11 and 17 could be curled into two overlying, tightly curled beads forming an inwardly open slot between which the annular rim 9 is entrapped, as illustrated in FIGS. 16 and 17.

After the pull ring 6 is formed the dies are opened and the spring loaded knockout tool 34 ejects the closure from between the dies.

Figure 13:
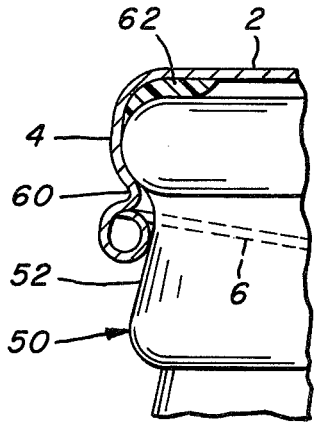
FIG. 13 is a portion of a cross-sectional view of an improved tear-off closure of the present invention after its application to the container.
Figure 14:
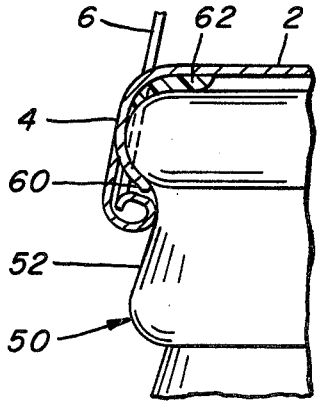
FIG. 14 is a portion of a cross-sectional view of an improved tear-off closure of the present invention after its application to the container showing the pull ring in the lifted position.

After the closure has been formed, a liner such as the plastisol liner 62 shown in FIGS. 13 and 14, is adhesively applied to the interior portion of the tear-off closure at the junction between the closure skirt 4 and the top end wall 2. The liner 62 is adapted to be compressed against the mouth of the container on which the closure is sealed to assure that a tight seal is provided on the capped container.

Figure 10:
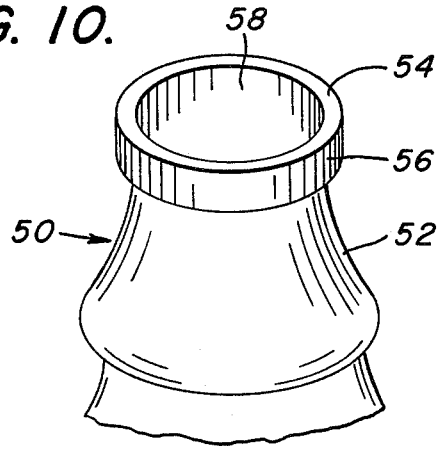
FIG. 10 is a perspective view of the top portion of a conventional crown finish container to which an improved tear-off closure of the present invention may be applied.

FIG. 10 illustrates a conventional crowned container 50 to which the tear-off closure of this invention is designed to be applied. The container 50 shown in FIG. 10 has a crown 52 and a mouth 58 with a bead 56 therearound for securing a closure over the mouth 58. There is a generally flat rim 54 around the top of the bead 56 with the inside of the rim 54 defining the circumference of the mouth opening 58 in the container 50.

Figure 11:
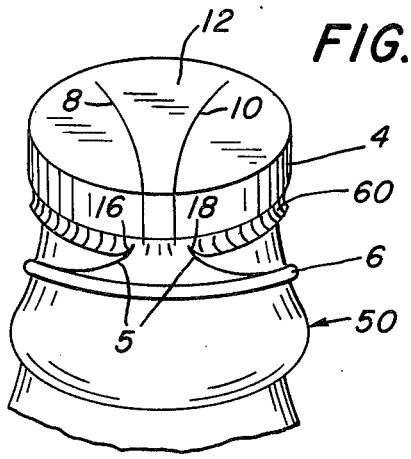
FIG. 11 is a perspective view of an improved tear-off closure of the present invention after application to a container.

FIG. 11 illustrates an improved tear-off closure of this invention after it has been applied to the container 40. In the capping operation the tear-off closure as shown in FIG. 1 is placed over the container mouth 58 of the container 50 shown in FIG. 10, such that the plastisol liner 62 applied to the inside surface of the top end wall 2 rests on the rim 54 of the container 50. The closure skirt 4 extends downwardly around the outside portion of the container bead 56. Capping is effected by constricting the bottom edge portion 60 of the closure skirt 4 in such a manner that the terminal edge portion 19 of the annular rim 9 is turned inwardly under and against the annular outwardly projecting container bead 56 around the entire periphery of the container mouth 58, shown as 60 in FIG. 11.

As a result of the inward constriction of the terminal edge portion 19 of the annular rim 9, the pull ring 6 is separated from its entrapment with the terminal edge portion 19 of the annular rim 9 at the bottom of the closure skirt 4 along the line of separation 14. The pull ring 6, however, remains integrally attached to the closure skirt 4 at the base of the tear strip 12 even though the inward constriction extends through this connection.

Figure 12:
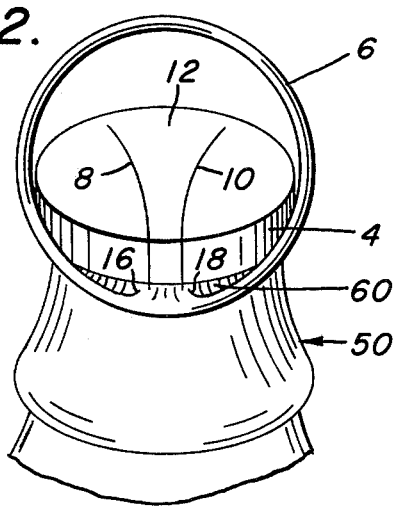
FIG. 12 is a perspective view of an improved tear-off closure of the present invention after its application to a container showing the pull ring with its free end in the lifted position.

To gain access to the contents of a container 50 having a tear-off closure of this invention applied thereto, the free end of the pull ring 6 is lifted over the closure skirt 4 and the top wall 2 as shown in FIG. 12. Since the pull ring 6 is integrally attached to the tear strip 12 at the base of the closure skirt 4 between the terminal ends 16 and 18 of the line of separation 14, and is larger than the diameter of the closure skirt 4, the pull ring 6 will pivot about its attachment to the tear strip 12 as illustrated in FIGS. 12, 13 and 14. Further, the attached portion of the beaded pull ring 6 will preferably cam against the exterior surface of the container mouth 50 as the pull ring 6 is lifted. Lifting the pull ring 6 stresses the unscored metal between the terminal ends 16 and 18 of the line of separation 14 and the score lines 8 and 10 to rupture or tear such metal into the score lines 8 and 10. The preferred inward and upward direction of the curved metal edge 5 in the pull ring 6 adjacent the closure skirt 4, as shown in FIG. 11, guides or directs the tearing of the metal generally tangentially into the score lines 8 and 10 along both sides of the tear strip 12.

Figure 15:
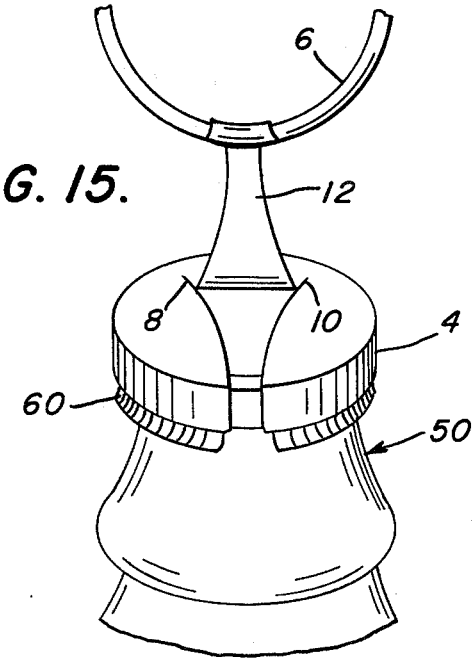
FIG. 15 isa plan view showing opening of an improved tear-off closure of the present invention.

Upon rupture of the unweakened metal between the ends 16 and 18 of the line of separation 14 and the score lines 8 and 10, the pull ring 6 is attached only to the tear strip 12. Thus, when the ring 6 is pulled upwardly the score lines 8 and 10 defining the tear strip 12 control or guide the line of tearing. In this way, continued displacement of the pull ring 6 causes separation of the tear strip 12 from the closure along substantially the full length of the score lines 8 and 10 to effectively split the closure, as shown in FIG. 15. Splitting the closure relieves the circumferential stress about the bottom edge 60 of the closure skirt 4 so the closure can be easily lifted off the container 50 by further pulling of the ring 6.

Whereas the particular embodiments of this invention have been described above for purposes of illustration, it will be apparent to those skilled in the art that numerous variations of the details may be made without departing from the invention.

What is claimed is:

1. A method of forming a tear-off closure comprising the steps of:

drawing a metal disc into a closure shell having a top end wall, a closure skirt around the top end wall, an annular rim extending outwardly from the bottom of the closure skirt and a wall depending from the outer edge of the annular rim;

severing said rim at a location between said skirt and said depending wall part way around the closure to leave an outwardly projecting edge at the bottom of the closure skirt;

curling a bottom edge of said depending wall inwardly under said outwardly projecting edge on the closure skirt; and curling the top edge of said depending wall inwardly over said outwardly projecting edge to form a beaded pull ring with an inwardly open slot therein in which at least a portion of said outwardly projecting edge of the closure skirt is entrapped.

2. A method as set forth in claim 1 which includes cutting score lines in the metal disc to define a tear strip across the closure to be formed.

3. A method as set forth in claim 2 in which said rim is severed along a line of separation extending from a location adjacent the score line on on side of the tear strip around the closure skirt to a location adjacent the score line on the other side of the tear strip.

4. A method as set forth in claim 3 in which at least one bridge of unsevered metal is provided in the line of separation.

* * * * *